United States Patent [19]

Vogt et al.

[11] Patent Number: 4,925,601

[45] Date of Patent: May 15, 1990

[54] METHOD FOR MAKING MELT-BLOWN LIQUID FILTER MEDIUM

[75] Inventors: Clifford M. Vogt, Roswell; Nancy D. Twyman, Norcross; Roe C. Allen, Jr., Roswell, all of Ga.

[73] Assignee: Kimberly-Clark Corporation, Neenah, Wis.

[21] Appl. No.: 145,065

[22] Filed: Jan. 19, 1988

[51] Int. Cl.[5] ..... D04H 3/16; B29D 7/00

[52] U.S. Cl. ..... 264/6; 156/167; 264/12; 264/518; 264/115; 264/DIG. 48

[58] Field of Search ..... 264/6, 12, 518, DIG. 75, 264/DIG. 48, 115; 156/167, 296

[56] References Cited

U.S. PATENT DOCUMENTS

| | | | |
|---|---|---|---|
| 3,959,421 | 5/1976 | Weber et al. | 264/6 |
| 3,998,185 | 8/1976 | Buntin et al. | 264/121 |
| 4,267,002 | 5/1981 | Sloan et al. | 264/DIG. 75 |
| 4,714,647 | 12/1987 | Shipp, Jr. et al. | 156/167 |
| 4,724,114 | 2/1988 | McFarland et al. | 264/510 |

*Primary Examiner*—Jan H. Silbaugh
*Assistant Examiner*—MaryLynn Fertig
*Attorney, Agent, or Firm*—William D. Herrick

[57] ABSTRACT

A process for making a melt-blown nonwoven polymeric web for use as a liquid filter medium includes increasing the air (fluid) flow and the forming distance to produce a filter medium that is more bulky and more permeable and therefore resists plugging. The melt-blown process parameters include a polymer throughput between 1.8 and 2.9 PIH, a polymer melt temperature between 530° and 600° F., and air flow rate between 200 and 265 SCFM per square inch, air temperature between 500° and 600° F., forming distance between 12 and 23 inches, and a collector vacuum between 0.5 and 1.0 inch of water.

3 Claims, 1 Drawing Sheet

METHOD FOR MAKING MELT-BLOWN LIQUID FILTER MEDIUM

BACKGROUND OF THE INVENTION

This invention relates generally to filter media and more particularly concerns melt-blown filter media for use in filtering liquids.

In a variety of industrial applications, it is necessary to provide a lubricating coolant to protect production machines from friction-created heat build-up, such as in the aluminum can manufacturing industry. As the lubricating coolant is used in connection with the manufacture of aluminum cans, the lubricating coolant becomes contaminated with metal particles, dirt, hydraulic oils, tramp oils, and lubricating oils. In order to assure the proper operation of the can forming machines, it is necessary to remove those contaminants from the lubricating coolant before it is recycled.

Conventionally, lubricating coolants have been filtered by cotton filters having fiber sizes of about 12 to 35 microns in diameter. One such filter medium is sold under the trademark Schneider 501. Also, the assignee of the present invention has manufactured and sold a non-woven polypropylene filter under the trademark Cyclean®. The Cyclean® filter comprises a laminate having a central layer of melt-blown polypropylene material sandwiched between external layers of spun-bonded polypropylene material.

It is important in filtering lubricating coolants to assure not only that the filter medium has an appropriate efficiency to filter out the contaminants from the lubricating coolant, but that the filter also provides effective filtration for a reasonable period of time before it becomes plugged and must be renewed.

SUMMARY OF THE INVENTION

It is therefore an object of the present invention to provide a melt-blown liquid filter medium which, when sandwiched between conventional layers of spun-bonded nonwoven material, will have an efficiency comparable to that of prior filter media but will last nearly twice as long as prior filter media for filtering lubricating coolants before it becomes plugged.

The foregoing object is achieved by making a high-bulk, melt-blown filter medium which is more open than prior filter media. Particularly, the filter media of the present invention is made by means of a melt-blowing process in which the air flow has been increased to between 390 and 525 standard cubic feet per minute, the forming distance has been increased to between 12 to 23 inches, and the underwire vacuum is kept at a minimum.

DETAILED DESCRIPTION OF THE INVENTION

While the invention will be described in connection with the preferred embodiment and process, it will be understood that we do not intent to limit the invention to that embodiment or process. On the contrary, we intend to cover all alternatives, modifications, and equivalents as may be included within the spirit and scope of the invention as defined by the appended claims.

Figure 1:
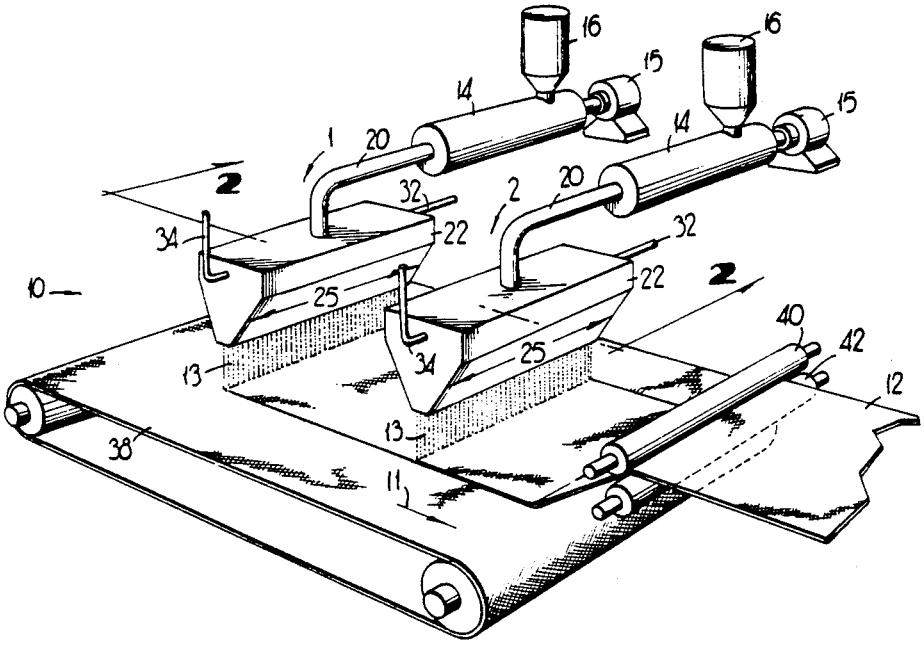
FIG. 1 is a perspective schematic view of the machinery for carrying the melt-blowing process of the present invention.

Turning to FIG. 1, there is shown a two-bank melt-blown production line or machine 10 for forming a melt-blown web 12. The melt-blown machine 10 is conventional in most respects and includes identical banks 1 and 2. Each bank has a die head 22 which deposits a layer of melt-blown polymeric microfibers 13 onto a foraminous belt 38 moving in the direction of arrow 11.

Each bank includes an extruder 14 with a hopper 16 for receiving thermoplastic resin pellets. The extruder 14 includes an internal screw conveyor which is driven by a drive motor 15. The extruder 14 is heated along its length to the melting temperature of the thermoplastic resin pellets to form a melt. The screw conveyor, driven by motor 15, forces the thermoplastic material through the extruder into the delivery pipe 20 which is connected to the die head 22 having a die width 25.

Figure 2:
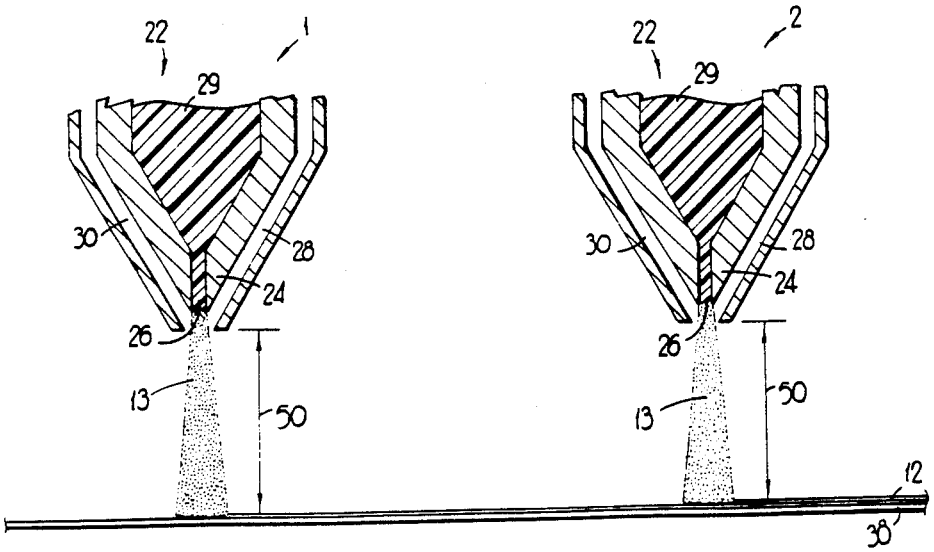
FIG. 2 is a detailed cross-section view of the die heads taken along line 2—2 of FIG. 1.

The die head 22, which is shown in cross-section in FIG. 2, comprises a die tip 24 which has a die opening or orifice 26 therein. Hot fluid, usually air, is supplied to the die tip via pipes 32 and 34 which terminate in channels 28 and 30 adjacent outlet 26 of the die tip.

As thermoplastic polymer 29 exits the die tip at opening 26, the high pressure air attenuates and breaks up the polymer stream to form microfibers 13 which are deposited on the moving foraminous belt 38 to form the web 12. The foraminous belt 38 is spaced from the die orifice by a forming distance 50. A vacuum is drawn behind the foraminous belt 38 to draw the fibers onto the belt 38 during the process of melt-blowing. Once the fibers have been deposited on the moving belt 38, the web 12 is drawn from the belt 38 by rolls 40 and 42.

The foregoing description of the melt-blowing machinery 10 is in general conventional and well-known in the art. The characteristics of the melt-blown web 12 can be adjusted by manipulation of the various process parameters used in carrying out the melt-blown process on the melt-blowing machinery 10. The following parameters can be adjusted and varied in order to change the characteristics of the resulting melt-blown web;

1. Type of polymer,
2. Polymer through-put (pounds per inch of die width per hour—PIH),
3. Polymer melt temperature (°F.),
4. Air flow (standard cubic feet per minute—SCFM),
5. Air temperature (°F.),
6. Distance between die tip and forming belt (inches),
7. Vacuum under forming belt (inches of water).

The basis weight of the web is controlled by increasing the speed of belt 38 to lower the basis weight or decreasing the speed of belt 38 to raise the basis weight.

Prior to the making of the present invention, the assignee of the present invention has been manufacturing and selling a liquid filter medium under the trademark Cyclean®. The Cyclean® filter medium is a laminate of a melt-blown polypropylene web sandwiched between layers of spun-bonded polypropylene material. The internal melt-blown layer is produced by combining two melt-blown webs each having a basis weight of 2.7 oz./yd.$^2$. The external layers are each 1.0 oz./yd.$^2$ spun-bonded polypropylene fabric. The layers are ultrasonically bonded together along three lines in the machine direction. The internal melt-blown polypropylene web for the Cyclean® filter is formed in accordance with the following process parameters:

| Example 1 (See Table 1) | |
|---|---|
| 1. Polymer | Polypropylene, PC973-himont USA, Inc., Wilmington, Delaware |
| 2. Polymer through-put | 2.5 PIH |
| 3. Polymer Melt Temperature | 565° F. |
| 4. Air Flow | 170 SCFM/in$^2$ of opening |
| 5. Air Temperature | 550° F. |
| 6. Distance between die tip and forming belt | 10 inches |
| 7. Vacuum under forming belt | 3–4 inches of water |

When two 2.7 oz./yd.$^2$ layers of the melt-blown fabric of Example 1 are sandwiched between 1.0 oz./yd.$^2$ spun-bonded fabric to form the Cyclean® filter medium, and subjected to a slurry having known amounts of particulate, the Cyclean® filter medium is prone to plugging, requiring changing or indexing of the filter medium.

We have discovered that by increasing the forming distance and increasing the air flow in the melt-blown process used to manufacture Cyclean®, it is possible to produce a melt-blown fabric which when sandwiched between 1.0 oz./yd.$^2$ spun-bonded external fabric layers will provide essentially the same filtration efficiency as the Cyclean® filter medium but will be able to filter more than twice the amount of filtrate before it is considered plugged.

While we do not intend to be bound by any particular theory, we believe that the additional air flow and additional forming distance allow the polymer microfibers to solidify and randomly mix to a greater extent prior to being deposited on the forming belt. Consequently, the resulting melt-blown webs of the present invention have a more open matrix of fibers and a substantially higher bulk or thickness than the melt-blown web used in the Cyclean® filter medium. The higher bulk appears to produce a greater number of paths through the filter medium and thus provides the ability to hold more particulate. Because the bulk is greater, those additional paths may be more tortuous as they pass through the filter medium, thus entrapping particulate nearly as efficiently as the less bulky Cyclean® filter medium.

The materials suitable for use in the present invention as polymeric or thermoplastic materials include any materials which are capable of forming fibers after passing through a heated die head and sustaining the elevated temperatures of the die head and of the attenuating air stream for brief periods of time. This would include thermoplastic materials such as the polyolefins, particularly polyethylene and polypropylene; polyamides, such as polyhexamethylene adipamide, polycaprolactam, and polyhexamethylene sebacamide; and polyesters, such as polyethylene terephthalate. Polypropylene is preferred.

Any gas which does not react with the thermoplastic material under the temperature and pressure conditions of the melt-blowing process is suitable for use as the inert gas used in the high velocity gas stream which attenuates the thermoplastic materials into fibers or microfibers. Air has been found to be suitable at flow rates, generally, in the range of from about 200 SCFM/in$^2$ to about 265 SCFM/in$^2$. The air temperature used in the process of the present invention is generally conventional and not critical to success of the process. A conventional air temperature between 500° F. and 600° F. is suitable.

The underwire vacuum or exhaust in the process of the present invention must be kept low enough to retain microfibers on the forming belt without compacting the resulting web. In general the vacuum is set within a range between 0.5 and 1.0 inch of water, and settings within that range are not critical to successfully carrying out the process of the invention.

In order to illustrate the melt-blowing process of the present invention, melt-blown webs were prepared in accordance with the process parameters set forth in Table 1 below. Samples 1–2 and 4–7 were made in accordance with the present invention. Sample 3 was made with a short forming distance to determine if reduced plugging of the resulting medium was dependent only on increased air flow. The control sample was the internal melt-blown filter medium of the Cyclean® filter. All samples were made using polypropylene resin PC 973 manufactured by himont USA, Inc., Wilmington, Del.

TABLE 1

| Sample | Melt Flow (PIH) | Melt Temp. (°F.) | Air Flow (SCFM)* | Air Temp. (°F.) | Vacuum (Inches) $H_2O$ | Forming Distance (Inches) |
|---|---|---|---|---|---|---|
| 1 | 2.7 | 560 | 525 | 500–600 | 0.5–1.0 | 16 |
| 2 | 2.7 | 560 | 435 | 500–600 | 0.5–1.0 | 23 |
| 3 | 2.7 | 560 | 435 | 500–600 | 0.5–1.0 | 9 |
| 4 | 2.7 | 530 | 435 | 500–600 | 0.5–1.0 | 16 |
| 5 | 2.7 | 575 | 480 | 500–600 | 0.5–1.0 | 19.5 |
| 6 | 2.7 | 575 | 390 | 500–600 | 0.5–1.0 | 12.5 |
| 7 | 2.7 | 590 | 435 | 500–600 | 0.5–1.0 | 16 |
| Control | 2.5 | 565 | 340 | 500–600 | 3–4 | 10 |

* Per 1.98 in$^2$ of opening.

The seven samples and control sample possessed the following physical properties set forth in Table 2 below.

TABLE 2

| Sample | Basis Weight (oz/yd$^2$) | Air Permeability (CFM/ft$^2$) | Bulk (Inches) |
|---|---|---|---|
| 1 | 5.1 | 21 | .073 |
| 2 | 5.6 | 23 | .087 |
| 3 | 5.1 | 14 | .056 |
| 4 | 5.2 | 34 | .080 |
| 5 | 5.9. | 19 | .104 |
| 6 | 5.4 | 17 | .083 |
| 7 | 5.9 | 17 | .142 |
| Control | 5.4 | 15 | .060 |

Air permeability was determined by measuring the air flow through the samples for a given surface area at a pressure drop of 0.5 inch of water. Based on the high air permeability and bulk, samples 2 and 4 were selected for further testing. The low air permeability and bulk of sample 3 indicated that high air flow in the melt-blowing process without increased forming distance would not produce an improved filter medium. Samples 7 and 4 suggest that the melt temperature should be set as low as possible to produce an extrudable melt for the particular polymer being used.

Each of the media samples 2 and 4 was laminated between 1.0 oz./yd.$^2$ layers of spun-bonded polypropylene material, the same spun-bonded material used in the Cyclean® filter. The resulting laminates were tested for air permeability, water flow, Mullen Burst, tensile strength in the machine direction, average filter efficiency, and number of cycles to plug at 30 psi. In addition, a competitive cotton filter medium, Schneider 501, was included in the test protocol. The results are tabulated in Table 3 below.

TABLE 3

| Sample | Total B.W. (Oz/yd$^2$) | Mullen Burst (PSI) | Tensile Strength-MD (lbs) |
|---|---|---|---|
| Control | 7.4 | 125 | 30 |
| 4 | 7.2 | 115 | 20 |
| 2 | 7.6 | 120 | 23 |
| Cotton 501 | 15.0 | 180 | 140 |

| Sample | Air Permeability (CFM/ft$^2$) | Water Flow (CFM/ft$^2$) | Filter Efficiency (%) | No. of Cycles To Plug |
|---|---|---|---|---|
| Control | 10–20 | 150 | 76 | 7 |
| 4 | 24–37 | 280 | 70 | 15 |
| 2 | 19–27 | 260 | 62 | 19 |
| Cotton 501 | 20–25 | 280 | 57 | 22 |

The results tabulated in Table 3 were derived based on the following test protocols. The Mullen Burst test is a standardized test for determining the strength of a web (TAPPI Standard T-403 OS-74). A given circular area of the material is stretched across a diaphragm, and the diaphragm is inflated until the inflated diaphragm causes the sample to burst. The air pressure of inflation of the diaphragm represents the comparative value between the samples tested. The test results relate to the ability of the sample to withstand the flow of water through the filter medium.

Tensile strength was measured in the machine direction of the web in accordance with Federal Test Method 191A. Air permeability was measured at a pressure drop across the samples of 0.5 inch of water. Water flow was measured across the samples at a pressure drop of 10 psi. The filter efficiency was measured by subjecting the filter medium to a slurry of water and particulate dust and determining the portion of particulate dust that passed through the filter medium. The slurry included 200 mg of dust per liter of water. The dust used was natural Arizona dust provided by General Motors under the designation AC Fine Air Cleaner Dust, which dust had an analysis as follows:

| | |
|---|---|
| 0–5 microns | 39 +/− 2% |
| 5–10 microns | 18 +/− 3% |
| 10–20 microns | 16 +/− 3% |
| 20–40 microns | 18 +/− 3% |
| 40–80 microns | 9 +/− 3% |

The number of cycles to plug was determined in the following manner. A 500 ml aliquot of the slurry used in connection with the efficiency test was placed in a tank. The tank was charged to 30 PSIG, and a ball valve at the bottom of the tank was open. The slurry flowed through the sample and into a container. After all the slurry passed through the sample, the process was repeated. Each time the tank was pressurized to 30 PSIG. After a number of cycles, the dirt had built up in the test sample to the point that no more liquid would pass through in a reasonable time span. This point was taken as the end point of the test. The total number of aliquots that passed through the sample was taken as the representative number of cycles to plug at 30 psi. The number of cycles has no particular absolute meaning but is useful for comparing samples of filter media with regard to their ability to withstand plugging.

As can be seen from the results in Table 3, both samples 2 and 4 lasted more than twice as long as the control sample. Particularly, sample 4 not only had more than double the life expectancy of the control sample but was able to pass the slurry nearly twice as fast, as indicated by the water flow rates. The enhanced performance of sample 4 in terms of plugging and flow rate was achieved while the efficiency of the filter medium was only reduced from 76% to 70%, well within the performance required for such liquid filters, especially in view of the 57% efficiency of the Cotton 501 competitive filter.

We claim:

1. In a process for making a melt-blown liquid filter medium which process includes heating a polymer resin to a melt temperature sufficient to produce an extrudable melt, extruding a stream of the melt at a through-put rate through a die orifice in a die head having a die width, directing fluid, having a fluid temperature, at a flow rate toward the melt exiting the die orifice to break up and attenuate the melt stream to form fibers, and collecting the fibers on a collector to form a web by means of a vacuum drawn beneath the collector, which collector is displaced from the die orifice by a forming distance, the improvement comprising:

a. extruding the polymer melt through the die orifice wherein the through-put rate of the polymer resin is between 1.8 and 2.9 pounds per inch of die width per hour;

b. directing fluid toward the melt as it exits the die orifice, wherein the fluid flow rate is between 200 and 265 standard cubic feet per minute per square inch;

c. setting the forming distance between 12 and 23 inches; and d. setting the vacuum between 0.5 and 1.0 inch of water.

2. The process of claim 1, wherein the through-put is 2.7 pounds per inch of die width per hour, the fluid flow rate is 220 standard cubic feet per minute per square inch, and the forming distance is 16 inches.

3. The process of claim 1, wherein the through-out is 2.7 pounds per inch of die width per hour, the fluid flow rate is 220 standard cubic feet per minute per square inch, and the forming distance is 23 inches.

* * * * *

UNITED STATES PATENT AND TRADEMARK OFFICE

CERTIFICATE OF CORRECTION

PATENT NO. : 4,925,601

DATED : May 15, 1990

INVENTOR(S) : C.M. Vogt, N.D, Twyman and R.C. Allen

It is certified that error appears in the above-indentified patent and that said Letters Patent is hereby corrected as shown below:

Column 2, line 42, "web;" should read --web: --;

Column 3, line 5, "PC973--himount USA" should read -- PC973--Himont USA--;

Column 4, line 20, "himont" should read --Himont--:

Column 4, lines 58 and 59, "Samples 7 and 4" should read --Samples 4 and 7 --;

Column 6, line 53, "through-out" should read -- through-put --;

Signed and Sealed this

Thirteenth Day of July, 1993

*Attest:*

*Attesting Officer*

Michael K. Kirk

MICHAEL K. KIRK

*Acting Commissioner of Patents and Trademarks*